US006067050A

United States Patent [19]

Shaker et al.

[11] Patent Number: 6,067,050

[45] Date of Patent: May 23, 2000

[54] TECHNIQUES FOR THE CANCELLATION OF BEAM SQUINT IN PLANAR PRINTED REFLECTORS

[75] Inventors: Jafar Shaker, Ottawa; Apisak Ittipiboon, Kanata; Michel Cuhaci, Ottawa, all of Canada

[73] Assignee: Her Majesty the Queen in right of Canada, as represented by the Minister of Industry through the Communications Research Centre, Ottawa, Canada

[21] Appl. No.: 09/082,909

[22] Filed: May 22, 1998

[30] Foreign Application Priority Data

May 22, 1997 [CA] Canada ..... 2205873

[51] Int. Cl.[7] ..... H01Q 1/38

[52] U.S. Cl. ..... 343/700 MS; 343/781 P; 343/836

[58] Field of Search ..... 343/700 MS, 754, 343/755, 757, 781 P, 781 R, 836, 837

[56] References Cited

U.S. PATENT DOCUMENTS 4,180,817 12/1979 Sanford ..... 343/700 MS
4,684,952 8/1987 Munson et al. ..... 343/700 MS

*Primary Examiner*—Don Wong
*Assistant Examiner*—Tho Phan
*Attorney, Agent, or Firm*—Gordon Freedman; Neil Teitelbaum

[57] ABSTRACT

Due to the frequency dependence of phasing mechanisms applied in planar printed reflectors, when using planar printed reflector antennas beam squint occurs as the frequency is scanned within the operating band. In order to reduce or eliminate beam squint, an incident signal incident upon a reflector is altered in such a way that the outgoing signal retains a same direction. In an embodiment, this is achieved by providing feed elements in different locations, each feed element for feeding a signal of a different frequency. In another embodiment, two reflector arrays are used wherein beam squint caused by the first reflector array is compensated for by the second reflector array.

20 Claims, 17 Drawing Sheets

PRIOR ART (a) 9.9 GHz (b) 10.2 GHz

TECHNIQUES FOR THE CANCELLATION OF BEAM SQUINT IN PLANAR PRINTED REFLECTORS

FIELD OF THE INVENTION

The invention relates generally to planar reflector array antennas and more particularly to a planar reflector antenna array having substantially less beam squint over a range of frequencies.

BACKGROUND OF THE INVENTION

The emergence and widespread application of various schemes for wireless and satellite communications has prompted research on low cost candidates for components of a communication system. The simplicity of the manufacturing process, reliability and ease of operation are among the other driving factors in the design of wireless systems. Antennas as the radiating and receiving elements are not an exception to this general trend. Recently, planar reflectors have been considered as a viable option that fulfils the stringent design requirements of wireless systems. Such a planar array is described in D. C. Chan and M. C. Huang, "Microstrip reflectarry with offset feed", *Electronics Letters,* pp. 1489–1491, July 1992. Ease of manufacturing, deployment and operation are among the advantages of planar array antennas. More importantly, planar reflectors tend to minimize the feedline losses and thus enhance the effective utility of printed structures.

The physical principles governing the operation of planar printed reflectors are discussed previously in D. M. Pozar and T. A. Metzler, "Analysis of reflectarray antenna using microstrip patches of variable sizes", *Electronics Letters,* pp. 657–658, April 1993, and in F. S. Johansson, "A new planar grating reflector antenna", *IEEE Trans. Antenna and Propagt,* Vol. 38, No. 9, pp. 1491–1495, Sept. 1990. In general, an electromagnetic wave impinges on the surface of a planar reflector whose elements were designed so as to change the phase front of the electromagnetic excitation. Various methods such as dimensioning the patches, loading the patches, or proper placement of patches were used as means of transforming the phase front of the incoming wave. The fact that all of these methods are frequency dependent, has made planar printed reflectors prone to a beam squint as the frequency is scanned within the band.

A planar reflector with an offset feed is often designed to provide a high gain antenna, producing a collimated reflected signal. Since gain is related to beam width, a narrower more collimated beam is often desired. Unfortunately, as the distance between a transmitter and receiver is increased, a collimated beam must be more accurately armed from the transmitter in order to reach the receiver. When a collimated beam shifts a few degrees, the receiver may not even receive the outer edges of the beam. Also, as the beam direction changes, the receiver becomes more or less centrally located within the beam. This affects signal levels and therefore, affects signal to noise ratios. As such, it is important to direct a beam accurately from a transmitter.

Beam squint effectively alters an angle of reflection of a signal from a planar array. In essence, as the frequency of the signal varies, the angle of reflection of the signal also varies. This inherent limitation of planar printed reflectors is well known in the art and severely restricts application of planar reflector array antennas in satellite communications. Because of the close proximity of adjacent satellites in space, beam squint implies reception of unwanted signals from neighbouring satellites.

For communications, different applications are commonly allotted a set of frequencies—a frequency band. It would be advantageous to provide a planar reflector array antenna that has reduced beam squint over such a frequency band.

OBJECT OF THE INVENTION

It is an object of the invention to reduce the effects of beam squint caused by frequency shifts in a signal incident upon a planar reflector array antenna.

SUMMARY OF THE INVENTION

In a first embodiment, a second planar periodic structure is designed to shift the beam peak by an equal amount but opposite to the direction of the squint caused by the first reflector. Therefore, the final direction of the beam peak is stabilized. A phase matched feed is used in accordance with another embodiment of cancelling the beam squint. The phase matched feed is designed so that its active radiating region smoothly shifts as the frequency is swept within frequency band.

In accordance with the invention there is provided a reflector antenna, the reflector antenna for reflecting a signal, the reflector antenna comprising:

a first planar reflector array including a plurality of reflector elements disposed to reflect the signal;

beam squint prevention means for substantially preventing beam squint caused by shifts of frequency of the signal.

In accordance with another embodiment of the invention there is provided a reflector antenna, the reflector antenna for reflecting a signal, the reflector antenna comprising:

a first planar reflector array including a plurality of reflector elements disposed to reflect the signal with a first beam squint;

a second planar reflector disposed to receive the reflected signal from the first planar reflector and for reflecting the signal with a second beam squint, wherein the first beam squint and the second beam squint sum to form a constant angle of reflection from the second planar reflector.

In accordance with yet another embodiment of the invention there is provided a reflector antenna, the reflector antenna for reflecting a signal, the reflector antenna comprising:

a first planar reflector array including a plurality of reflector elements disposed to reflect the signal;

a feed including a plurality of feed elements, each feed element for radiating at a different frequency and spaced from the first reflector by a distance wherein the signal reflected from the first reflector has a substantially same direction when provided from any of the plurality of feed elements.

BRIEF DESCRIPTION OF THE DRAWINGS

Exemplary embodiments of the invention will now be described in conjunction with the following figures in which.

DETAILED DESCRIPTION OF THE INVENTION

Various methods of designing printed planar reflectors are known. These methods include loading, dimensioning of microstrip patches, and blazed gratings. Design of a planar reflector array for use in the present invention, is in accordance with these known design methods. A commercial CAD package was used to fulfil design requirements of reflector arrays described herein.

Figure 1:
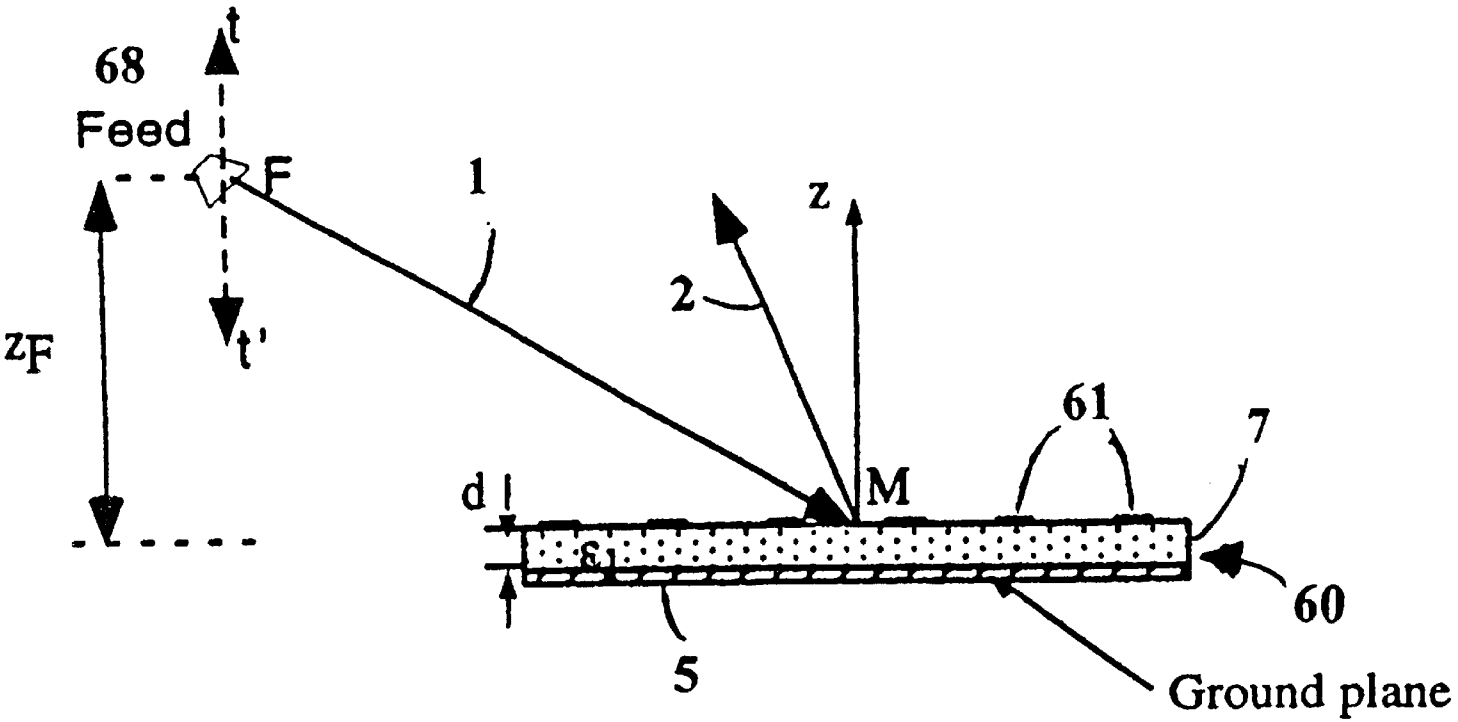
FIG. 1 is a side view of a planar reflector according to the prior art.

FIG. 1 shows a side view of a planar reflector. A "quasi periodic" array of patches 61 is etched on a top surface of a grounded dielectric slab 7 having a feed 68 in the form of, for example, a horn at a "focal point" thereof. Alternatively, another type of feed is used. In FIG. 1, the dielectric slab 7 is grounded with a ground plane 5 disposed thereon on a side opposite the array of patches 61. The attributes of the patches 61—dimension, loading, placement or a combination thereof—are smoothly varied throughout the structure so that the feed location approximates the focal point of the planar reflector; this is what is meant herein by "quasi periodic." Essentially, features of patches on a top surfaces of the planar reflector 60 are varied in a manner that enables the structure to transform an incoming spherical wave 1 emanated from the feed 68 into a reflected plane wave 2. The function of the planar reflector 60 is analogous to a "planar phase front transformer". Of course depending upon design requirements, different features of an etched pattern on the top surface of the planar reflector are changed to obtain the required phase shift and transform the phase front of the wave that impinges on a specific locality of the reflector surface. This is well known in the art. The term top surface as used herein refers to a surface of the planar reflector 60 receiving a signal from the feed 68; of course, the antenna may be moved rendering the "top surface" on the bottom side of the antenna, but this is still referred to, for clarity, as the top surface.

Figure 2:
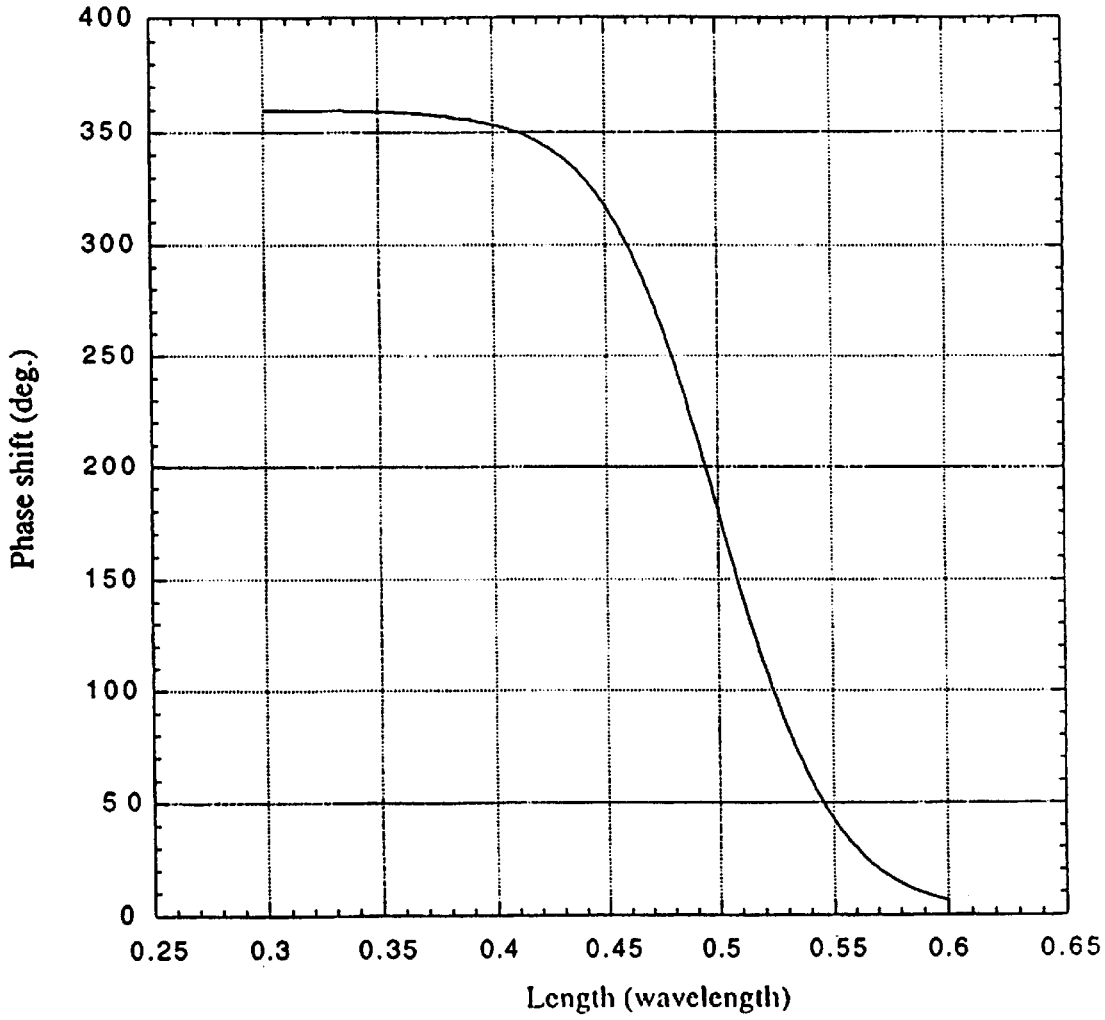
FIG. 2 shows a typical curve of an amount of phase shift introduced in an incident wave as it is reflected versus the length of a rectangular patch that is used as a cell element of a periodic structure.

One method of creating a required phase shift pattern is by smoothly varying dimensions of reflective elements, in the form of rectangular patches, on a top surface of the planar reflector. First, the elements are arranged in a periodic configuration and cell dimensions are constant throughout the structure. It is known that a plane wave illuminating a periodic structure of rectangular patches goes through a phase shift as it is reflected. FIG. 2 shows a typical curve of an amount of phase shift introduced in an incident wave as it is reflected from a planar reflector array, versus rectangular patch length that is used as a cell element of a periodic structure. As operating frequency of an antenna changes, the phase shift at some localities of the planar reflector goes to saturation resulting in beam squint. According to the embodiments described herein, rectangular patch lengths at each locality are dimensioned so as to introduce a required phase shift into the reflected wave from that locality. By applying this throughout the reflector array, a quasi-periodic structure—not exactly periodic—capable of acting as a "phase front transformer" results. The structure mimics a conventional reflector such as a parabolic reflector.

Figure 3:
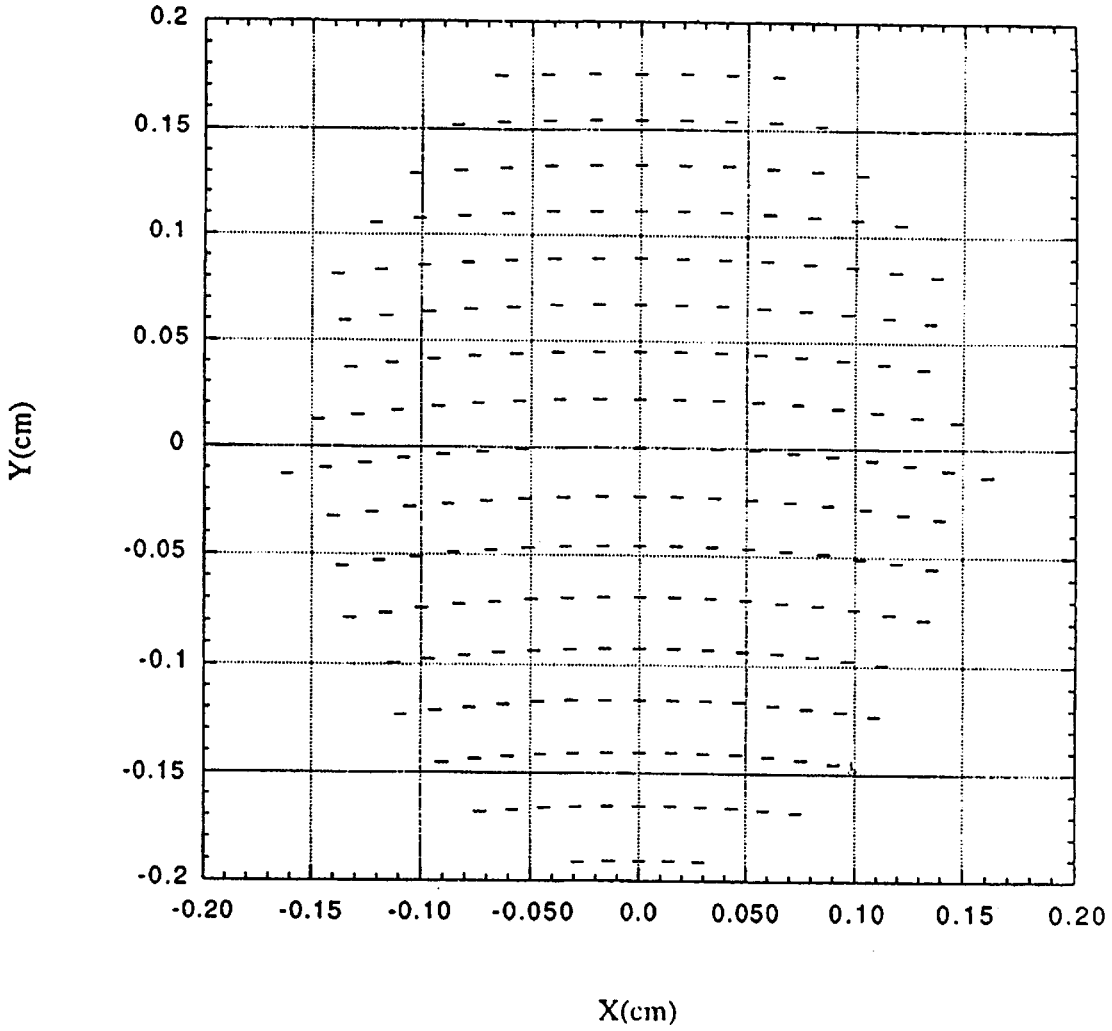
FIG. 3 is a typical configuration of elements for a quasi periodic offset feed planar reflector array.

A printed planar reflector is also realised by proper placement of the elements on a grounded dielectric slab. As in the previous example of planar reflector array design, a feed is disposed at a "focal point" of the planar reflector. For design, each locality of the planar reflector 60 is assumed to illuminated by a plane wave 1 whose direction is dictated by relative location of that locality with respect to a phase centre of the feed 68. The periodicity of the elements at that specific location are adjusted so as to excite a higher order Floquet's mode, (0,−1) in this case, in a desired direction. This procedure is applied throughout the planar reflector 60 in order to span the reflector elements in a certain lattice. A typical configuration of elements throughout the surface is shown in FIG. 3. The cell dimensions are adjusted to provide propagation of a desired higher order Floquet's mode. The direction of propagation of (m,n)th mode is obtained using the following relationships;

$$k_{ymn} = k_0 \sin\theta_{(mn)} \sin\phi_{(mn)} = k_0 \sin\theta_{inc} \sin\phi_{inc} + \frac{2\pi n}{T_y} \tag{2}$$

$$k_{zmn} = \sqrt{k_0^2 - k_{zmn}^2 - k_{ymn}^2} \tag{3}$$

$$k_{xmn} = k_0 \sin\theta_{(mn)} \cos\phi_{(mn)} = k_0 \sin\theta_{inc} \cos\phi_{inc} + \frac{2\pi m}{T_x} \tag{1}$$

where (m,n) represent mode number, $T_x$ and $T_y$ are cell dimensions in x and y directions, $\phi_{inc}$ and $\theta_{inc}$ are propagation direction of an illuminating plane wave and $\phi_{(mn)}$ and $\theta_{(mn)}$ are propagation direction of a diffracted mode. The propagation direction of the (0,−1) mode is determined by setting (m,n) to (0,−1). Using the above relations (1), (2) and (3) and knowing the position of the feed 68 and desired direction of propagation of the diffracted mode 2, a lattice is determined for ensuring the propagation of the (0,−1). Floquet's mode in the given direction. Having determined the lattice, the length of the gratings—reflective elements 61—and slab 7 thickness are optimised in order to maximise energy coupled into (0,−1) mode. This is done for a central region of the planar reflector 60. This region contains a highest number of reflector elements 61.

Figure 4:
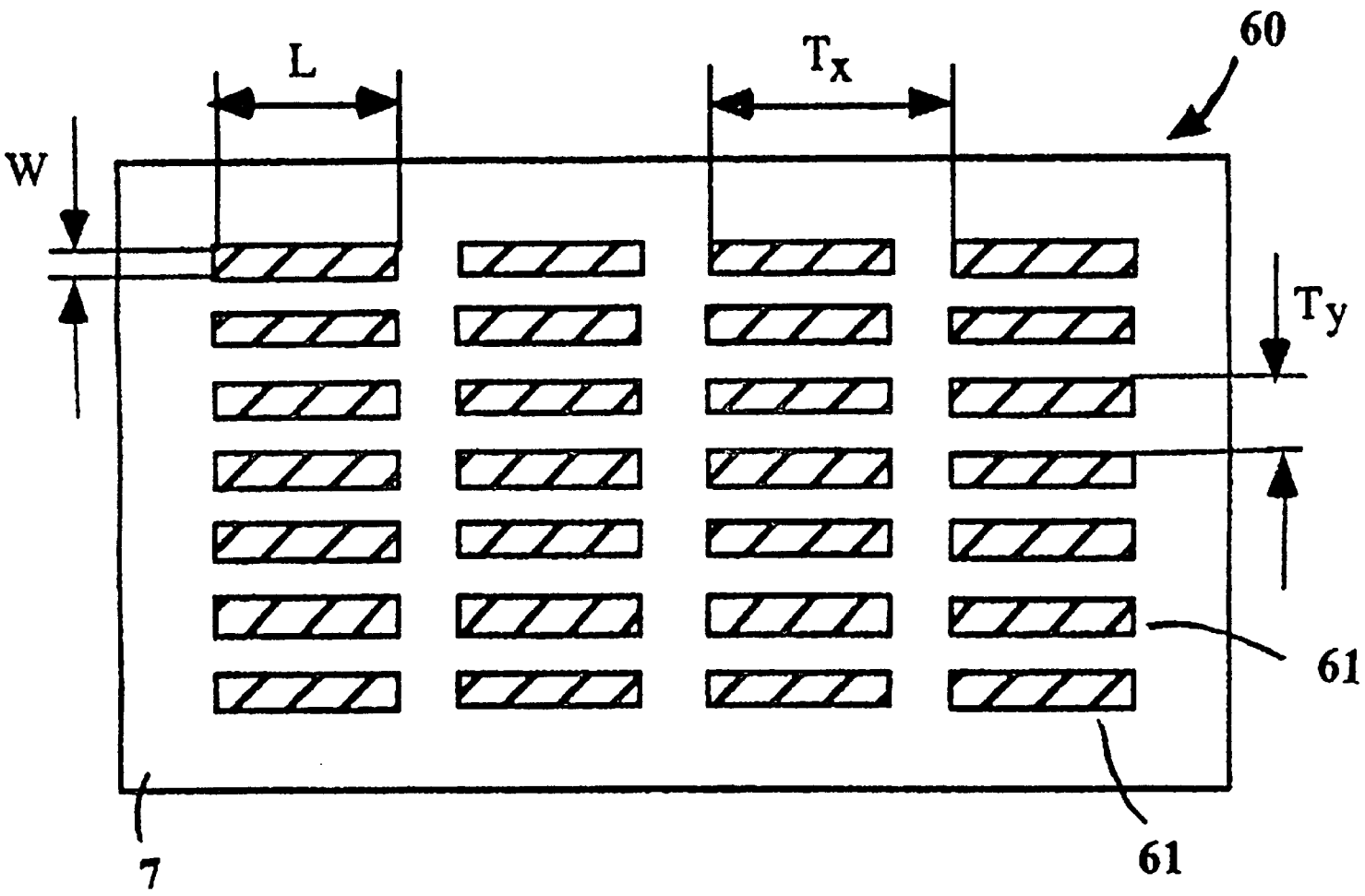
FIG. 4 is a top view of a periodic structure of rectangular gratings printed on a grounded dielectric slab.

Referring to FIG. 4, a top view of a periodic structure of rectangular gratings—reflector elements 61—printed on a grounded dielectric slab 7 is shown. This represents the central region of the planar reflector 60. In the diagram of FIG. 4, the central region is a periodic structure with a rectangular lattice. In order to determine an efficiency with which a desired (0,−1) mode is excited by different localities of the planar reflector 60, the locality is assumed to be a periodic structure of infinite extent illuminated by a plane wave 1 (not shown) whose direction matches the relative position of the feed 68 (not shown) with respect to that locality. Then, the relative power coupled to each mode is derived throughout the operating frequency band. Using such a method, each locality of a planar reflector array 60 is analysed to determine efficiency and so forth. Of course, when only some localities are of interest, only those localities are analysed.

Figure 5:
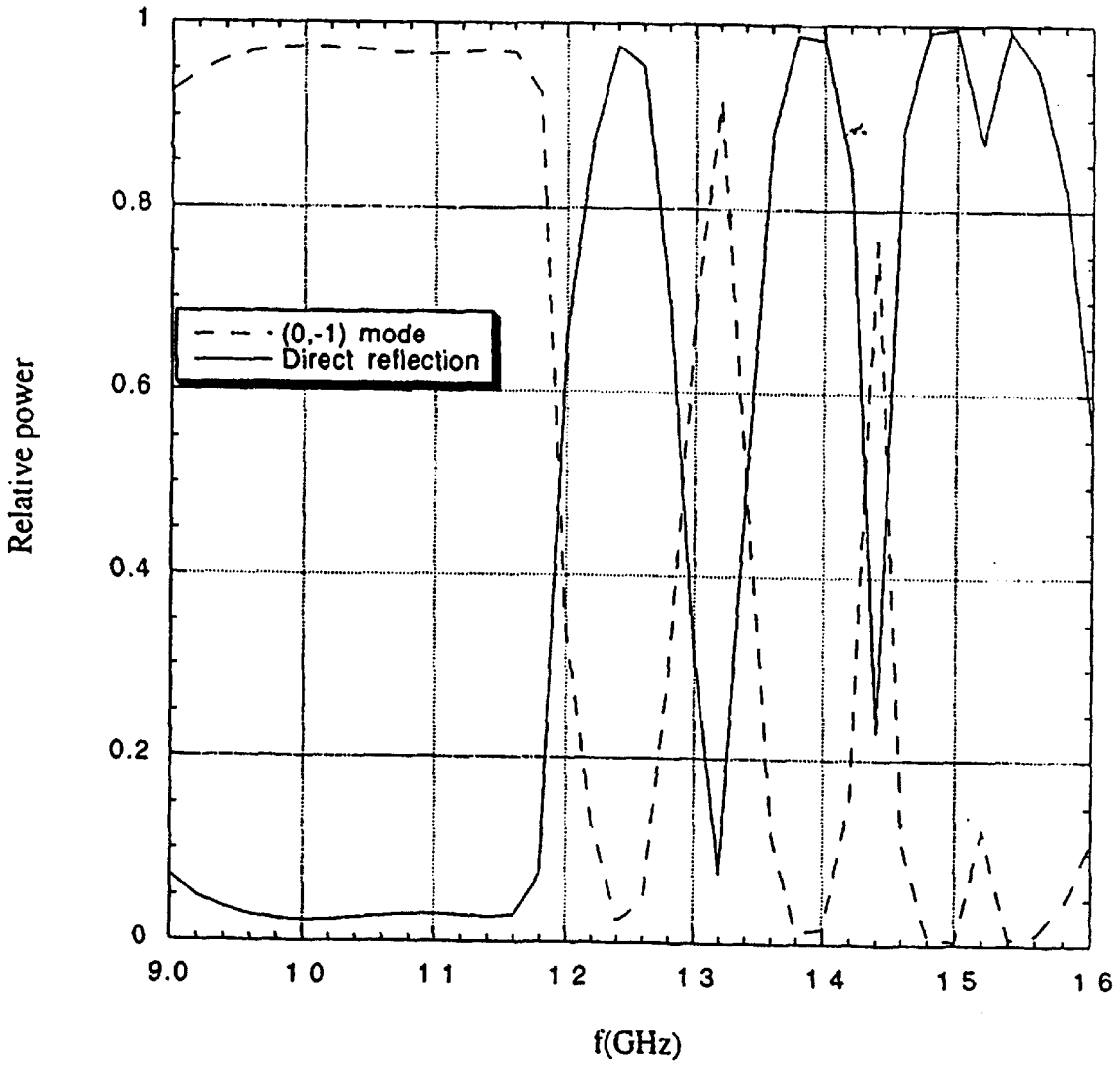
FIG. 5 is a graph showing the power coupled into propagating modes as a periodic structure of the same characteristics as the central region of a planar reflector illuminated by a plane wave travelling along the line that connects the phase centre of the feed to the same locality.

The graph shown in FIG. 5 shows power coupled into propagating modes for a periodic structure with characteristics of the central region of a planar reflector illuminated by a plane wave travelling along a line that connects the phase centre of the feed 68 to the central region. A moment method based algorithm was used to derive scattering characteristics of the periodic structure. Such a method is described in 4-R. Mittra, C. H. Chan and T. Cwik, "Techniques for analyzing frequency selective surfaces", *Proc. Of IEEE*. Vol 76, No. 12, Dec. 1988, pp. 1593–1614.

It is evident from equations (1), (2) and (3) that $k_{xmn}$ and $k_{ymn}$ are functions of frequency and, therefore, that the planar reflector array 60 is subject to the effects of beam squint. Though the embodiments described below are for reducing beam squint for planar reflectors with smoothly varying cell sizes, a same method is applicable to reduce beam squint for reflectarrays with smoothly varying element dimensions and/or other element parameters.

Figure 6:
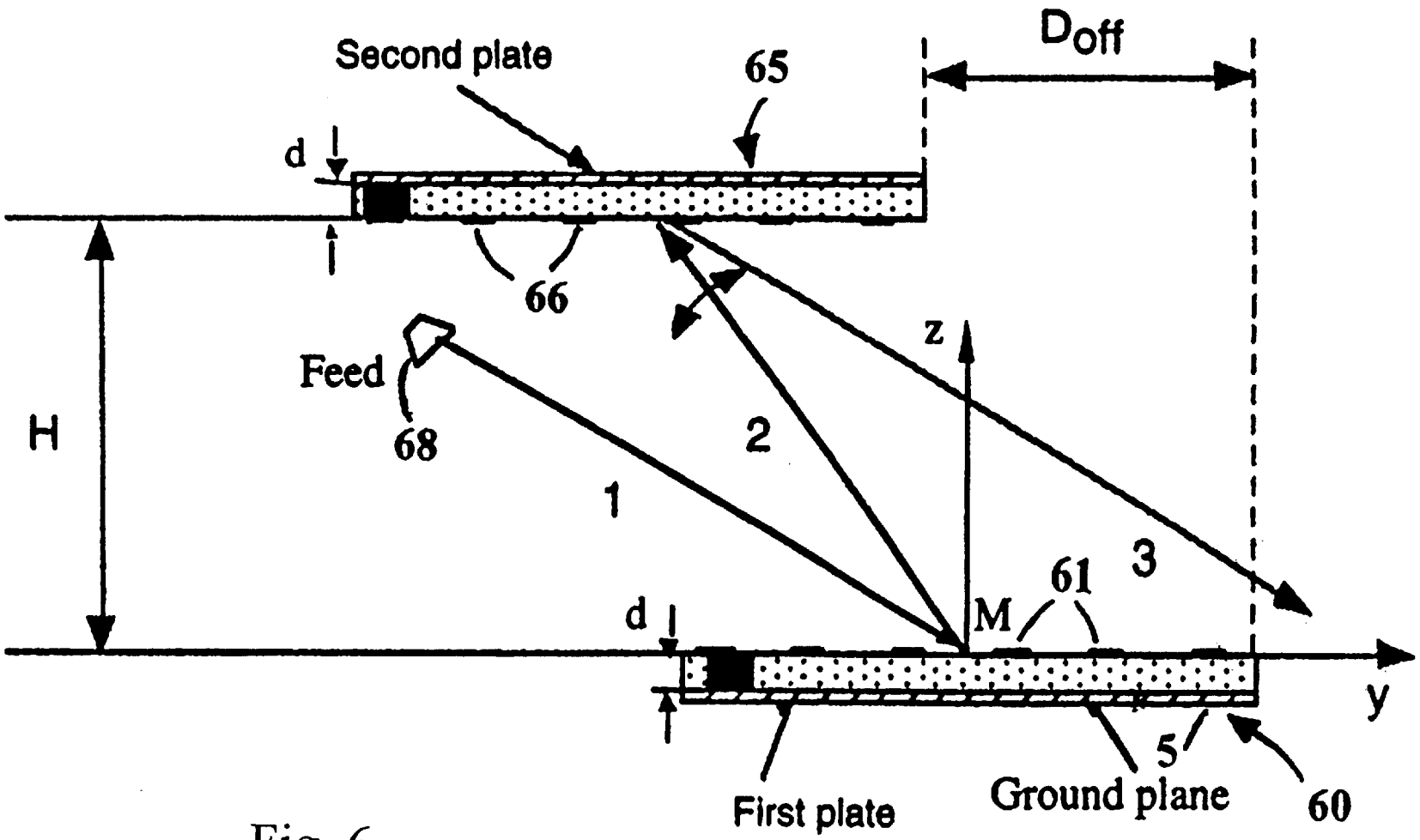
FIG. 6 is a side view of a dual planar reflector.

A dual planar reflector according to the invention is shown in FIG. 6. The antenna is described in operation in the transmission mode. The first plane 60 is a planar reflector composed of quasi-periodic structure of rectangular grating 61 which are arranged in a smoothly varying lattice and the second plate 65, which is parallel to the first plate 60, is a regular periodic structure of rectangular gratings 66 arranged in a rectangular lattice. A ray 1 emanating from the feed 68, impinges on the first reflector 60 and after being diffracted in the form of a higher order Floquet's mode, becomes the incident wave 2 for the second plate 65. The second plate 65 is designed to excite (0,−1) Floquet's mode when illuminated by ray 2 that originates from the first plate. As frequency shifts within an operating band, both the incident wave on the second plate 65 and the diffracted wave from the same plate undergo beam squint. Therefore, the squint of ray 3 shown in FIG. 6 is cancelled by the squint of the incident wave 2 on second plate 65, which leads to stabilisation of the propagation of the outgoing ray 3. A variational expression is derived below for use in determining dimensions of the second plate lattice so that the required cancellation occurs within the operating frequency range.

Ray 1 represents a spherical phase front, which is transformed into a planar phase upon reflection from the first plate 60 as ray 2. Since the second plate 65 is a regular periodic structure with rectangular lattice, ray 3 represents a planar phase front as well. Noting the above descriptions of the rays 1, 2, and 3 and setting (m,n) as (0,−1), $\phi_{(0,1)}^{(1)}=270°$ and $\phi_{inc}^{(1)}=90°$ in equation 2, the following relation results;

$$\sin\theta_{inc}^{(1)} + \sin\theta_{(0,1)}^{(1)} = \frac{\lambda_0}{T_y^{(1)}} \tag{4}$$

where $\theta_{inc}^{(1)}$ is an incident angle of the plane wave 1 travelling along a line that connects the phase centre of the feed 68 and the central region of the first plate 60, $\theta_{(0,1)}^{(1)}$ is the propagation direction of the diffracted plane wave 2 from the first reflector 60, $T_y^{(1)}$ is the lattice dimension along y in the central region of the reflector and $\lambda_0$ is the free space wavelength. The characteristics of the central region of the reflector are used in equation (4). Beam squint of the outgoing wave from the central region of the first reflector 60 represents the beam squint caused by the whole reflector. This is due to the fact that the lattice configuration of the first reflector 60 is designed such that outgoing diffracted rays travel in a predetermined direction regardless of which locality is illuminated.

A similar relation is determined for the second reflector 63;

$$\sin\theta_{inc}^{(2)} + \sin\theta_{(0,1)}^{(2)} = \frac{\lambda_0}{T_y^{(2)}} \tag{5}$$

where $\theta_{inc}^{(2)}$ is the incident angle of the plane wave 2 that illuminates the second plate 65, $\theta_{(0,1)}^{(2)}$ is the propagation direction of the diffracted plane wave 3 from the second reflector 65, $T_y^{(2)}$ is the lattice dimension along y for the second reflector 65 and $\lambda_o$ is the free space wavelength. According to the present embodiment, the second plate 65 is a regular finite periodic structure of rectangular gratings.

A small shift in the operating frequency of the antenna shown in FIG. 6, causes a differential variation in the angular parameters of Eq. (5). The following relation results between the angular variations and the frequency variations:

$$\Delta\theta_{inc}^{(2)}\left(\cos\theta_{inc}^{(2)}\right) + \Delta\theta_{(0,1)}^{(2)}\left(\cos\theta_{(0,1)}^{(2)}\right) = \frac{\Delta\lambda_0}{T_y^{(2)}} \tag{6}$$

Recalling that the objective of the present invention is to cancel the beam squint resulting for the ray 3, $\Delta\theta_{(0,1)}^{(2)}$ in the above equation is set to zero for a planar reflector array according to the invention.

$$\Delta\theta_{(0,1)}^{(2)}=0 \tag{7}$$

Also it is evident from the geometry shown in FIG. 6 that, $$\theta_{(0,1)}^{(1)}=\theta_{inc}^{(1)} \tag{8}$$

and therefore;

$$\Delta\theta_{(0,1)}^{(1)}=\Delta\theta_{inc}^{(2)} \tag{9}$$

Combining equations (6–9), the following relation is defined for the lattice dimension of the second plate 65;

$$T_y^{(2)} = \frac{\Delta\lambda_0}{\Delta\theta_{(0,1)}^{(1)}\left(\cos\theta_{(0,1)}^{(1)}\right)} \tag{10}$$

where $0_{(0,1)}^{(1)}$ is the angle of ray 2 at the centre frequency and $\Delta\theta_{(0,1)}^{(1)}$ is the variation of the same angle throughout the operating band. Both of these parameters are derived from Eq. (4). Calculation of the lattice dimension of the second plate 65 from Eq. (10) ensures the stabilisation of the outgoing ray 3. The lack of a constraint on $T_x^{(2)}$, results in a degree of freedom in determining the second plate lattice geometry. This freedom allows optimisation of the second plate parameters to maximise the power coupled into the outgoing ray 3, the outgoing (0,−1) mode.

Figure 7:
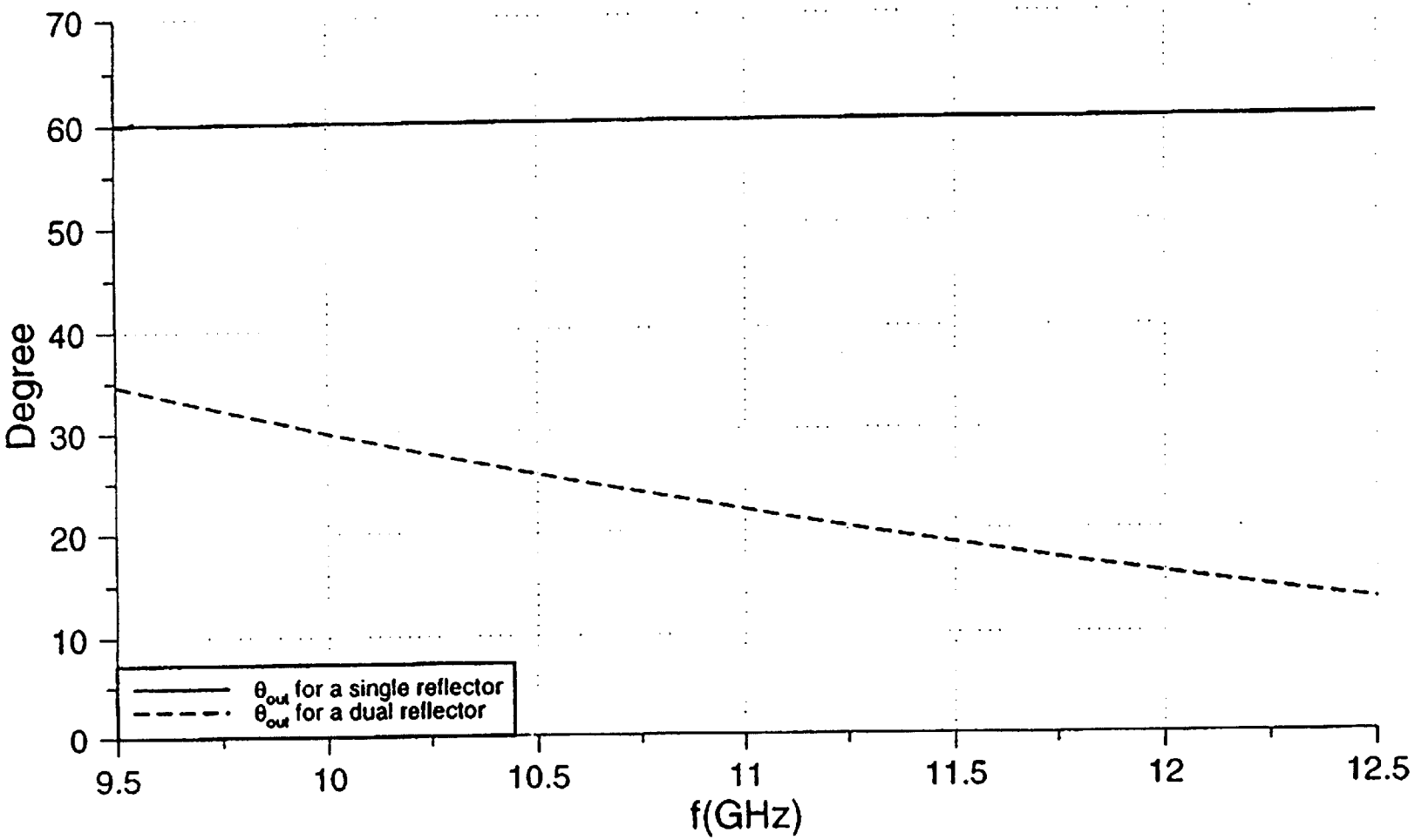
FIG. 7 is a graph showing simulation results for the beam squint in single planar reflector and dual planar reflector.

The graph shown in FIG. 7 shows simulation results for beam squint of a single planar reflector and a dual planar reflector according to the present invention. The graph of FIG. 7 shows that the use of a second reflector according to the invention suppresses beam squint throughout a wide band.

Preferably, the size and location of the second reflector 65 is adjusted to maximise the energy that is captured by the second plate 65 and minimise the blockage caused by the first plate 60. Simple geometrical considerations suffice to fulfil these requirements.

In an alternative embodiment, the feed is designed to reduce the effects of beam squint. The embodiment uses a feed comprising a plurality of feed elements with a single planar reflector array in order to provide signals of different frequencies from different locations. This, in effect, reduces or eliminates beam squint.

Referring to FIG. 1, movement of the phase centre of a feed is classified into two types: movements along FM or tt'. As the reflector is located in the far field of the feed, a slight movement of the phase centre along FM does not significantly affect the relative phase of the rectangular grating elements with respect to each other. On the other hand, movement of the phase centre along tt', changes the relative phase of the elements with respect to each other. This results in movement of main beam peak angle from its original position. Array factor formulation is used to calculate the main beam peak angle for different locations of the phase centre. Although array factor formulation is not reliable in side lobe or cross-pol. calculations, in the present example it was found to be sufficiently accurate for determining main beam angle. Likely, it is sufficiently accurate for other applications of the embodiment of this 2invention.

Figure 8:
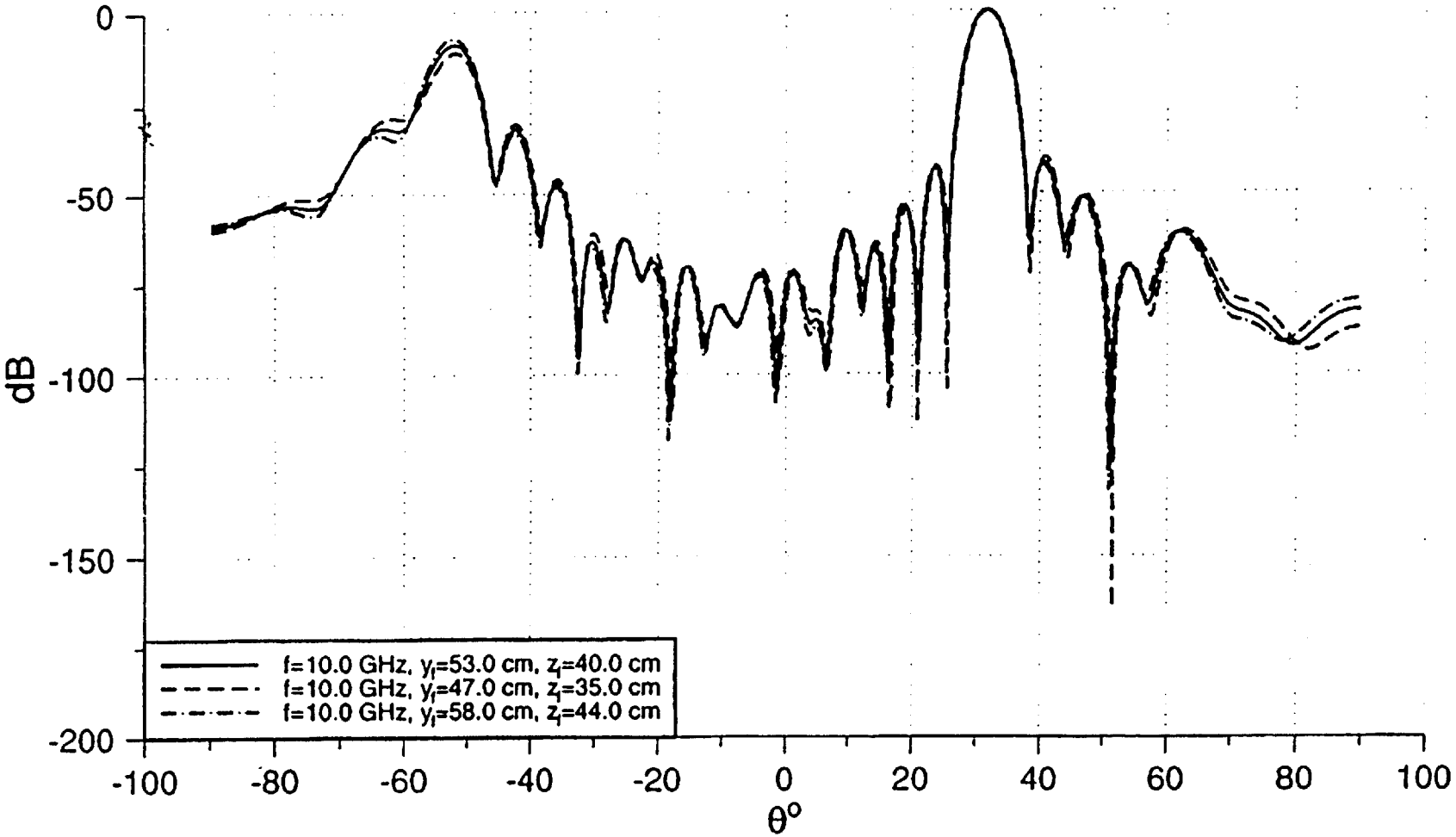
FIGS. 8 and 9 are graphs of radiation patterns for planar reflectors for different locations of a feed.
Figure 9:
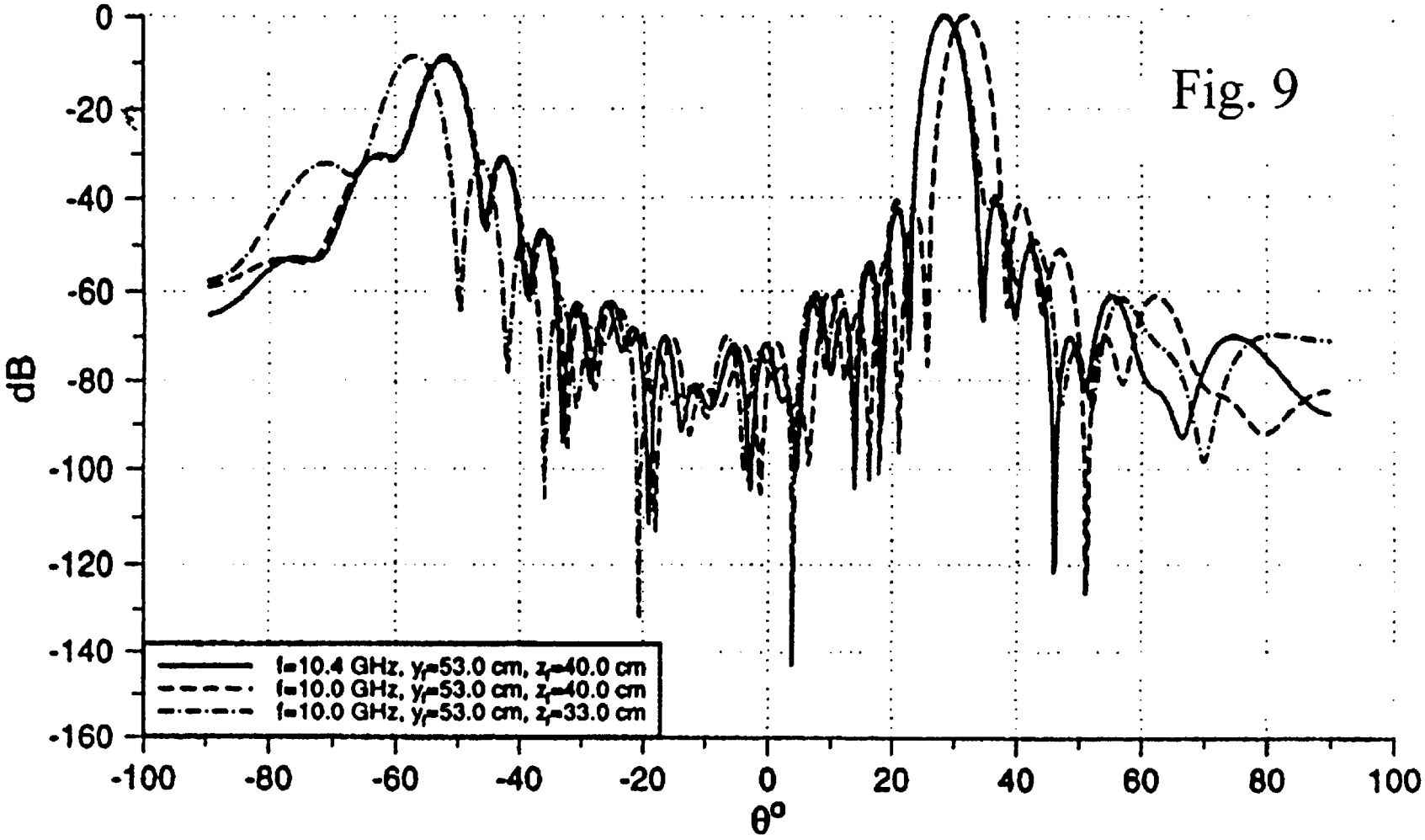

A number of computer simulations were performed and results are shown in FIGS. 8 and 9. First, the phase centre was moved along FM as the antenna was operating in one and the same frequency and the radiation patterns were plotted for different phase centre locations. It is evident from FIG. 8 that the main beam peak angle remains constant for slight movement of the phase centre along FM. The same numerical experiment was repeated for phase centre movement along tt' at two different operating frequencies. Comparison of a second curve and a third curve with the antenna operating at 10.0 GHz shows that the main beam peak angle changes as the phase centre is shifted slightly along tt'. A closer look at FIG. 9 establishes that, by proper adjustment of the location of feed phase centre along tt', beam squint cancellation results. Proper movement of the phase centre along tt' is shown to stabilise the beam peak angle in spite of a 0.4 GHz frequency shift.

Figure 10:
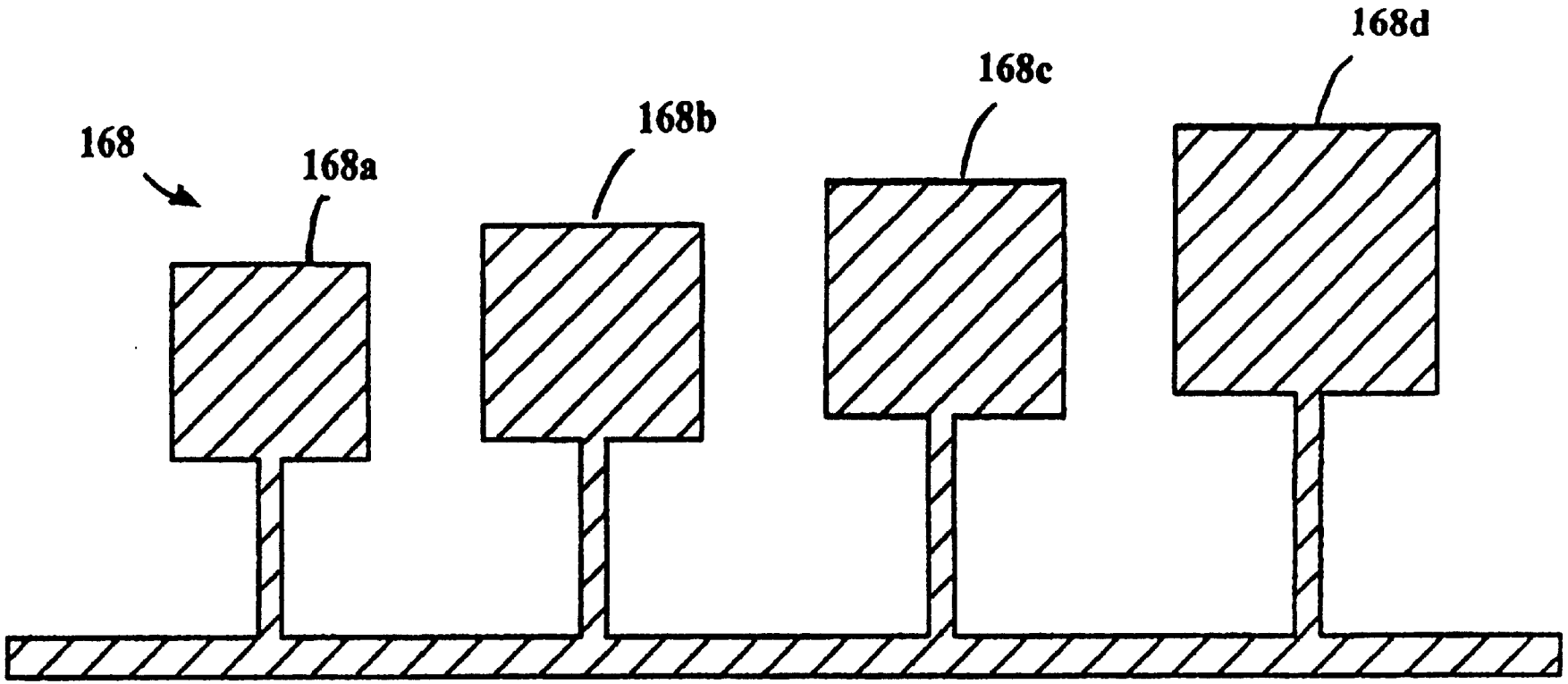
FIG. 10 is a diagram of a feed comprising a plurality of feed elements each for resonating at a different frequency according to the present invention.
Figure 11:
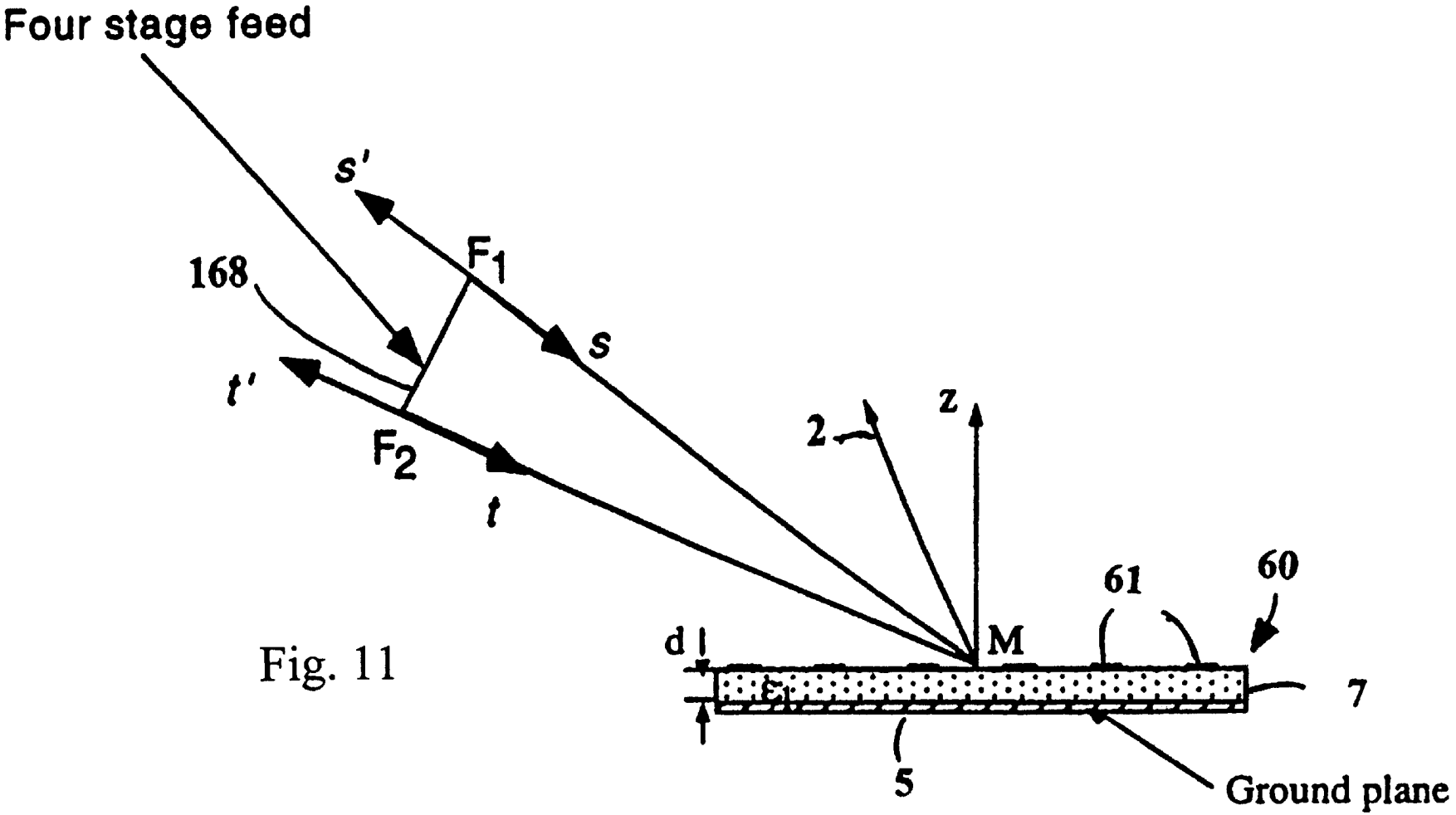
FIG. 11 is a side view of a reflector array fed by a feed according to an embodiment of the invention.

The antenna feed 168 shown in FIG. 10 is useful for automatically altering the feed centre location relative to the planar reflector array 60 (not shown). This antenna feed is composed of four series fed patches 168*a*–168*d* of different sizes. As the frequency changes within the operating band, resonance shifts from one patch to another. This results in a moving radiating region as the frequency is swept within band. The movement of the radiating region of the antenna feed is equivalent to the movement of the phase centre of the feed 168. The antenna feed shown was designed to minimise return loss and then disposed in a location so as to substantially reduce beam squint. The planar reflector used in conjunction with the four stage feed 168 of FIG. 10 is shown in FIG. 11. $F_1$ and $F_2$ represent the first 168*a* and last 168*d*—smallest and largest—patches of the four stage feed 168.

In this embodiment, several guidelines were used for optimising the feed design and placing it in a position that would result in beam squint cancellation. The feed dimensions were determined to minimise return loss. Once design was complete, location was determined for the feed 168 such that resulting phase centre movement reduces beam squint. The procedure followed in the feed design is discussed in detail in 5-H. Pues, J. Bogaers, R. Preck, and Van de Capelle, "Wideband quasi-log-periodic microstrip antenna", *IEE Proc. H, Microwaves, Opt. & Ant.,* 1981, 128, (3), pp. 159–163. The initial design method comprises the following steps:

- dividing the desired opening band into sub-bands as wide as the bandwidth of a microstrip antenna and the resonant frequencies are selected log periodically;
- calculating dimensions of the square patches and the resonant input impedance of each radiator;
- dimensioning the branch lines as quarter wavelength transformers between the appropriate resonant input impedance of the resonating patch and 50 Ω line where the main feed line is a simple 50 Ω line; and
- selecting the position of the branch lines so that the distance to the open circuit equals a multiple of half wavelength.

The initial design, according to the present embodiment, assumed that a resonating patch appears as 50 Ω load at an intersection of its respective branch line and a main line while other elements and the open circuit transform into high impedance at the same cross section. Therefore, the incoming wave on the feed line is absorbed and radiated by the resonant patch. After completion of the initial design based on the above guidelines, a commercial software package is used to optimise the return loss performance of the feed 168.

Having optimised the feed design, its location with respect to the reflector surface is determined, according to the invention, to suppress beam squint. The terms suppress, reduce, cancel, and eliminate as used herein with respect to beam squint indicate the cancellation of beam squint that would happen using a prior art reflector array antenna with a horn feed, for example. It is clear that using an embodiment with multiple feeds as herein proposed, avoids the problem of beam squint to some degree by moving the phase centre of the feed to compensate therefore.

Given a desired direction for the outgoing beam, the location of the four stage feed 168 is determined so that a point source that is located at $F_1$ or $F_2$ and operates at the resonant frequencies of the respective patches 168*a*, 168*d* at either of these two points gives rise to an outgoing beam 2 that travels in one same direction. The geometric locations of $F_1$ and $F_2$ are in the far field of the reflector and along ss' and tt', respectively. As mentioned above, assuming that the planar reflector is an infinite periodic structure of the same lattice as its central region and illuminated by a plane wave propagating along the line that connects the feed phase centre and reflector centre, a straightforward method for calculating direction of higher order modes results. Using these assumptions, equation (4) is used to calculate the direction of ss' and tt'. To apply equation (4) in this context, it is noted at $\theta_{(0,1)}^{(1)}$ is the desired direction of the outgoing beam, $\lambda_0$ is the wavelength of the operating frequency in free space, $T_y^{(1)}$ is the lattice dimension along y in the central region of the reflector for $\theta_{inc}^{(1)}$ is the unknown which gives the ss' or tt' direction depending on the valve provided for $\lambda_0$. In summary, the geometrical location of the feed phase centre is located in the far field of the reflector 60 and on a line that stretches out from the centre of the reflector 60 along a direction given by equation (4). The same procedure is performed for upper and lower frequencies of the operating band to derive a geometric location of the feed phase centre at these two frequencies (ss' and tt' shown in FIG. 11). When $\theta_1$ ($\theta_2$) is the direction of ss' (tt') and $F_1M$ is perpendicular to the feed surface, the following simple geometrical relation is used to derive $F_1M$:

$$F_1M = \frac{F_1F_2}{\tan(\theta_2\theta_1)} \tag{11}$$

As is evident to those of skill in the art, such a feed combined with a planar reflector according to the prior art and spaced therefrom as taught herein, results in a reflector antenna having substantially reduced beam squint over prior art planar reflector arrays. Of course, there are practical limitations to a number of feed elements that can be implemented in such a structure. These limitations are easily determined through experimentation in design and construction of a multi-element feed for use with the present invention.

Measurement results for the dual planar reflector are presented below. A dual planar reflector was designed to compensate for beam squint of a single planar reflector antenna. The location of the second plate 65 was selected to minimise blockage by the first plate 60. Simple geometrical observations establish the following relation:

$$H = \frac{L}{\tan\theta_{(0,1)}^{(2)}\tan\theta_{(0,1)}^{(1)}}$$

where "L" is the first plate dimension along y axis and $\theta_{(0,1)}^{(1)}$ ($\theta_{(0,1)}^{(2)}$) is the diffraction angle for the first (second) plate at the lowest frequency of the band. Maximisation of the energy captured by the second reflector 65 is used as a constraint to determine $D_{off}$ and the dimension of the second reflector 65. Spatial beam broadening is taken into account in enforcing this constraint.

Figure 12:
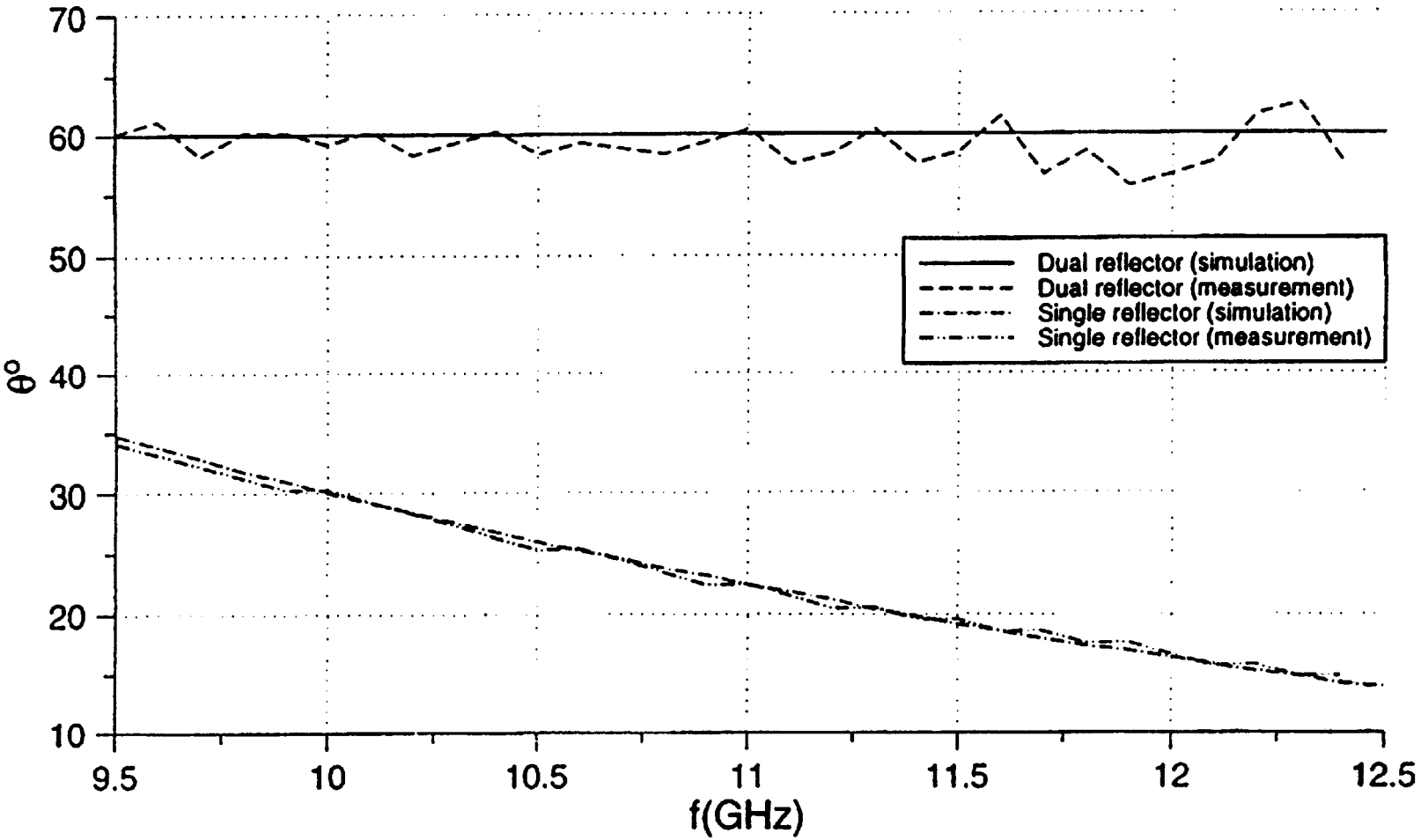
FIG. 12 is a graph showing a comparison between theoretical results and experimental results for beam squint in single and dual planar reflectors.

FIG. 12 shows a comparison between expectations as set out above and experimental results for beam squint in single and dual planar reflectors. Experiments demonstrated that the array factor method provides sufficient accuracy to estimate the beam peak angle of a planar reflector. Beam squint was reduced from 15° for a single reflector to approximately 3° for a dual reflector system in the band of 9.5–11.5 GHz. Therefore, a properly designed dual planar reflector system is capable of significantly reducing beam squint over a single planar reflector. Since for a given sweep angle as the distance between transmitter and receiver grows so does the sweep of a received signal measured in distance, reducing beam squint by 12 degrees is very significant even for relatively short distances such as those used terrestrially. For satellite implementation, a reduction of 12 degrees in beam squint is even more significant.

Figure 13:
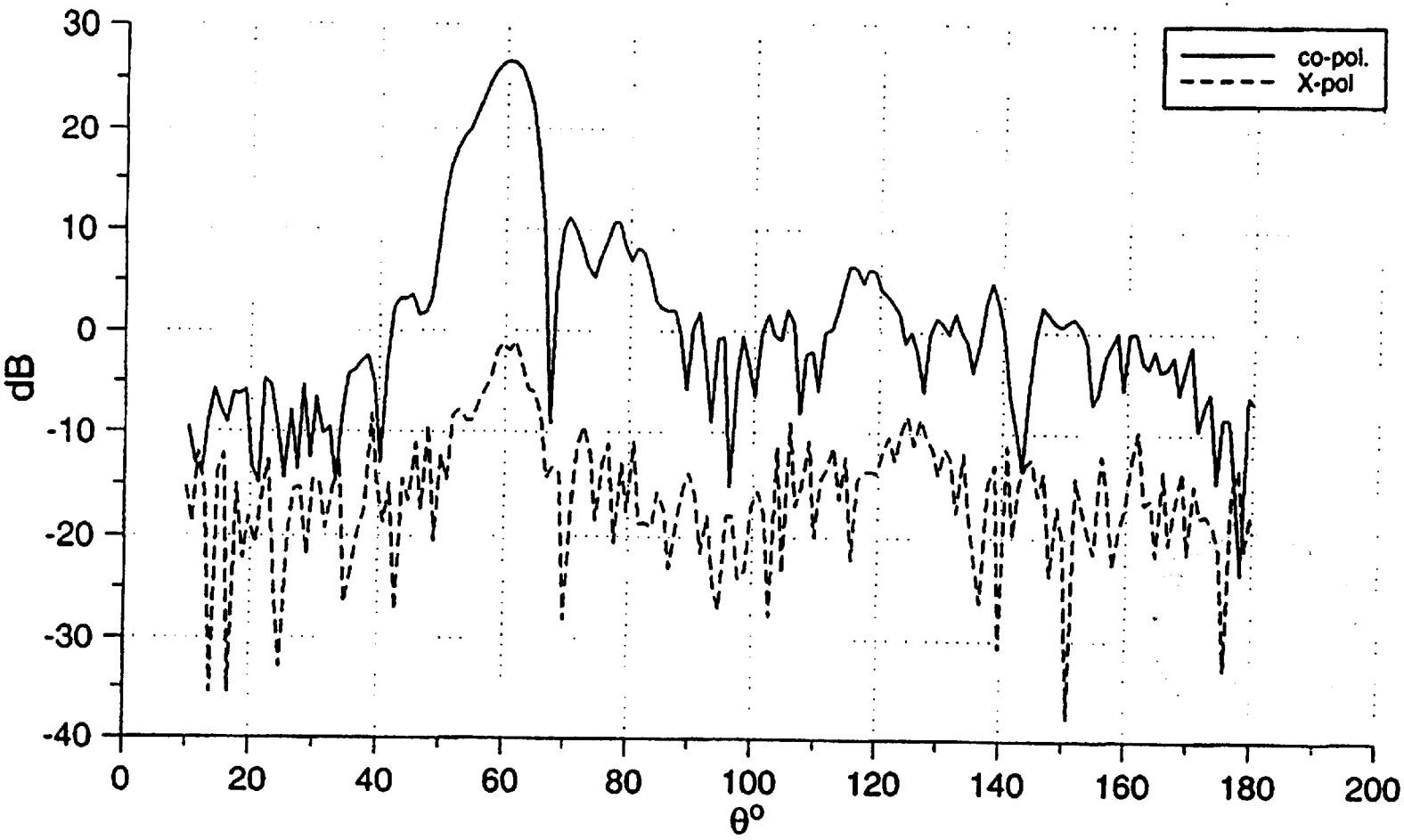
FIGS. 13 and 14 are graphs showing the co- and cross-pol. radiation patterns for the single and dual planar reflectors.
Figure 14:
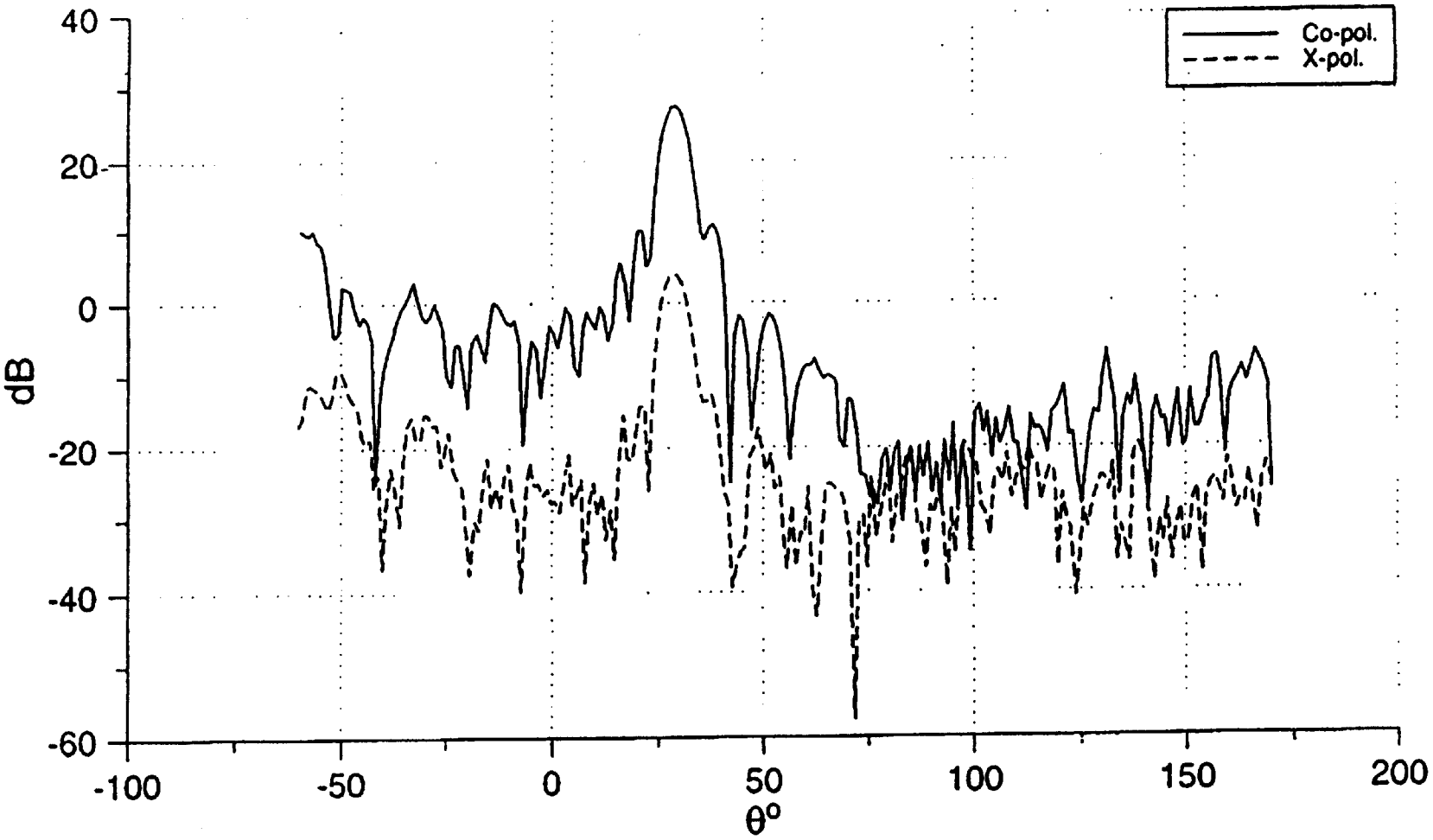

The co- and cross-pol. radiation patterns for the single and dual planar reflectors are shown in FIGS. 13 and 14. The size of the second reflector in the dual reflector system used for the simulations was not optimised. Therefore, the second reflector only partially captures the incoming energy from the first reflector. Therefore, lower gain and higher sidelobe levels result for the dual reflector compared to similar parameters for the single planar reflector antenna. On the other hand, the cross-pol. is approximately 5 dB lower for the dual reflector antenna. This is due, in part, to the further polarisation selectivity that is introduced by the presence of the second reflector. Hence, the cross-pol. of a single planar reflector is improved by using a second reflector.

Figure 15:
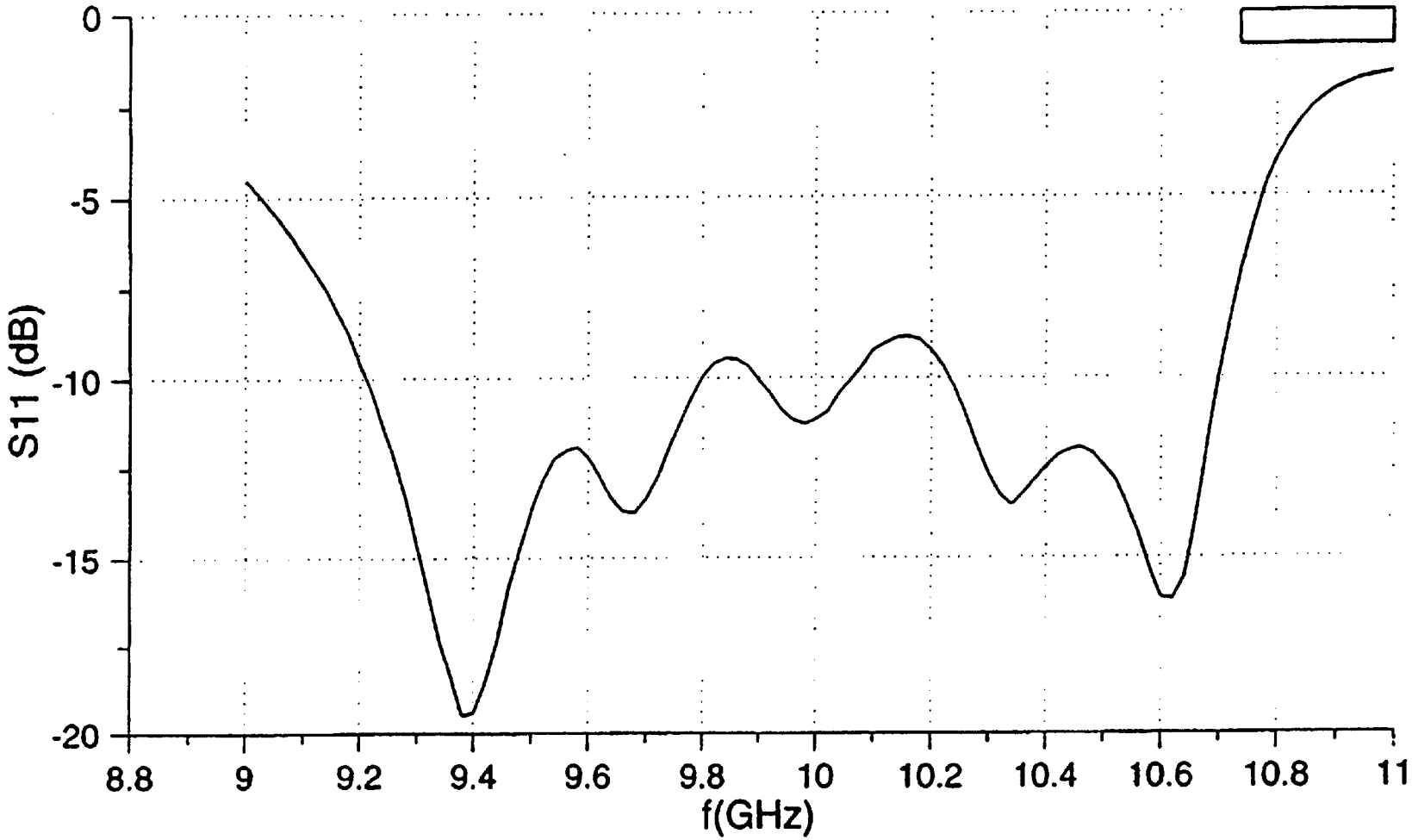
FIG. 15 is a graph showing the measured return loss throughout the band of the phase matched feed according to the invention.
Figure 16:
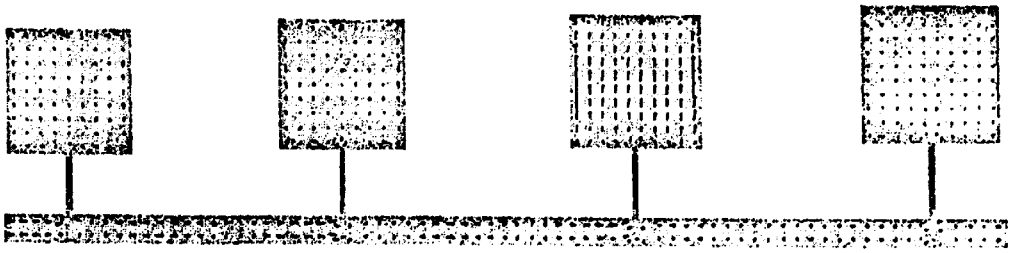
FIG. 16 is a graph showing typical plots of the current distributions for two frequencies; and, FIG. 17 is a graph showing measured and simulated variation of the beam peak angle versus frequency for a single planar reflector fed by a four stage microstrip feed.
Figure 16:
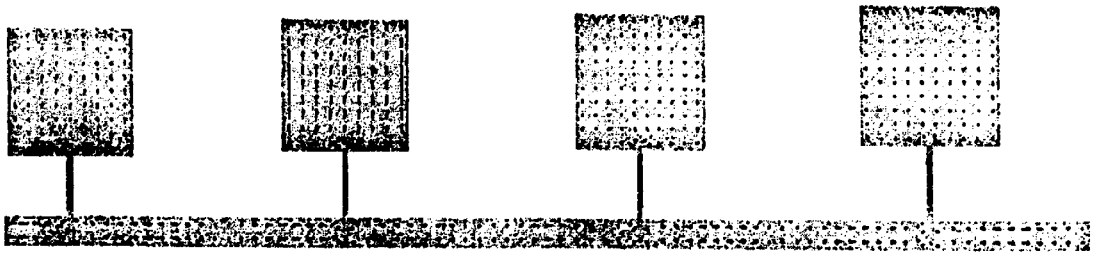

Referring to FIG. 15, a graph showing measured return loss throughout the band of the phase matched feed (shown in FIG. 10) in isolation from the reflector. There are five resonances shown in the measured return loss. The simulated current distributions at various frequencies within the band indicate that the first and last resonance are attributable to the last and first (largest 168*d* and smallest 168*a*) patches respectively, while the second, third and fourth resonances are due to simultaneous resonance of first patch 168*a* and second patch 168*b*, second patch 168*b* and third patch 168*c*, and third patch 168*c* and fourth patch 168*d*, respectively. Typical plots of the current distributions are shown in FIG. 16 for two frequencies. This figure demonstrates the moving nature of the radiating region as the frequency shifts within the band.

Figure 17:
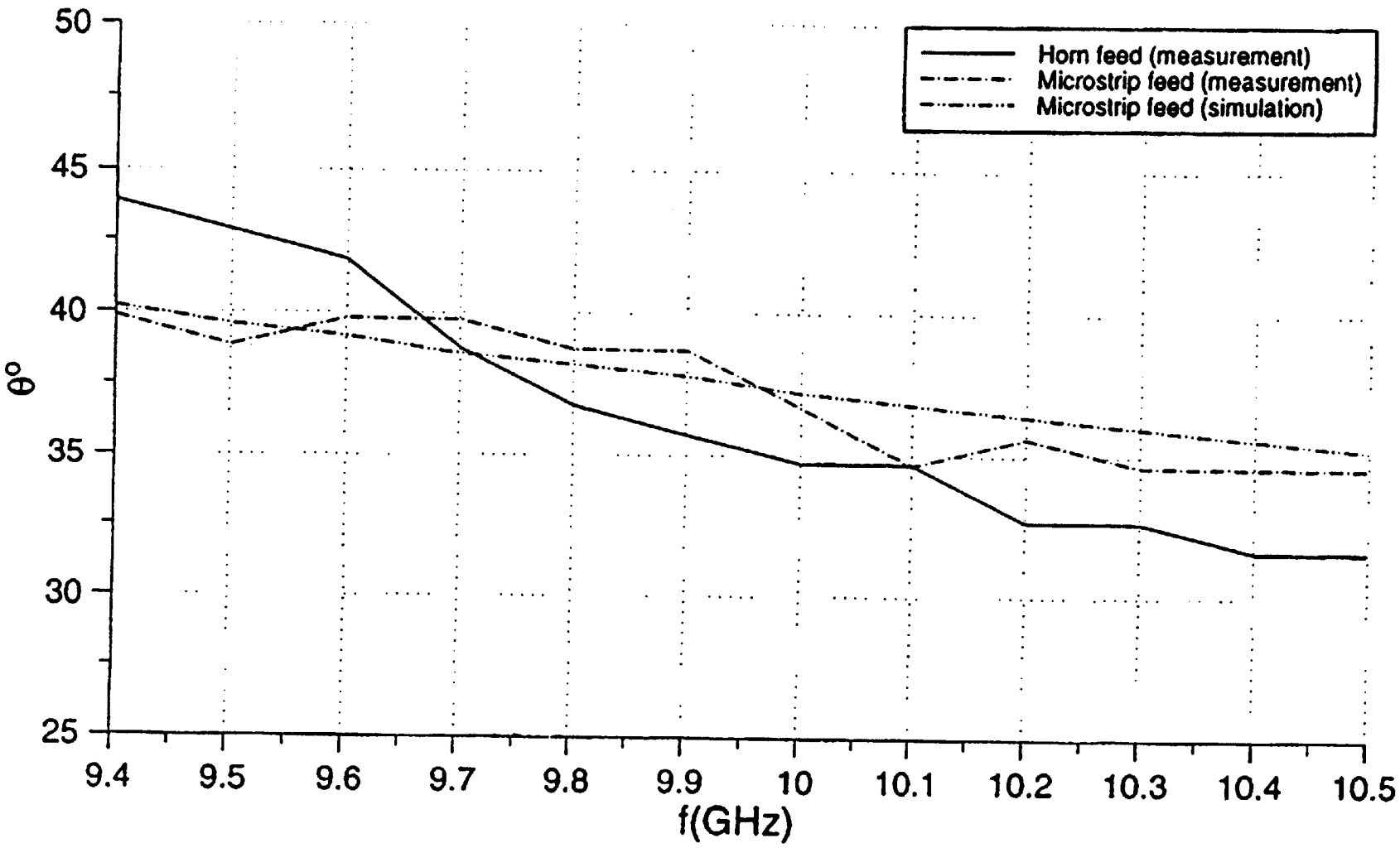

Measured and simulated variation of the beam peak angle versus frequency is shown in FIG. 17 for a single planar reflector fed by a four-stage microstrip feed. The microstrip feed was then substituted by an X-band horn and a similar measurement was performed. The measurement results for this later case are plotted in FIG. 17 for comparison. The beam squint is approximately 5° for a microstrip fed single reflector while the same parameter was measured to be 14° for a horn fed reflector as the frequency is scanned from 9.4 GHz to 10.6 GHz. Based on beam squint results for the microstrip fed reflector the operating band is divided into two sub-bands, namely, 9.4 GHz to 9.95 GHz and 10.1 GHz to 10.5 GHz. Beam peak angle variation in each of these bands is less than 2°. The sudden jump of the beam peak angle in the case of microstrip fed reflector around 9.95 GHz seems to correspond to a similar jump in current distribution. During simulation, the radiating region moves abruptly from the third patch 168*c* to the second patch 168*d* as the frequency is increased from 9.9 GHz to 10.1 GHz. The radiating region moves gradually for gradual increases of frequency beyond 10.1 GHz.

Though the above-described embodiments detail maximizing efficiency and minimising losses, this need not be performed according to the invention. Preferably, an antenna is designed for maximum efficiency in a particular operation.

Numerous other embodiments may be envisaged without departing from the spirit and scope of the invention.

What is claimed is:

1. An offset reflector antenna for reflecting a signal, the reflector antenna comprising:

a first substantially planar reflector array including a plurality of reflector elements disposed to reflect the signal received from at least a radiating element offset from the first substantially planar reflector;

beam squint prevention means in communication with the reflector for partially preventing beam squint caused by shifts of frequency of the signal within a known frequency band.

2. An offset reflector antenna as defined in claim 1 wherein the beam squint prevention means comprises another substantially planar reflector array, the other substantially planar reflector array disposed to receive the reflected signal from the first substantially planar reflector array and for reflecting the signal with a beam squint substantially equal to a constant amount of beam squint added to that beam squint occurring during reflection of the signal from the first substantially planar reflector array but in an opposite direction thereto.

3. An offset reflector antenna as defined in claim 2 wherein the constant amount of 0.

4. An offset reflector antenna as defined in claim 1 comprising a feed including a plurality of offset passive feed elements at different locations, each feed element being resonant at a different frequency, for radiating at its respective resonant frequency, and wherein the signal reflected from the first reflector has a substantially same direction when provided from any of the plurality of feed elements.

5. An offset reflector antenna as defined in claim 4 wherein the offset feed elements are spaced from the first substantially planar reflector array by a plurality of different distances.

6. An offset reflector antenna as defined in claim 1 wherein the plurality of reflector elements are arranged in a quasi periodic array.

7. An offset reflector antenna as defined in claim 1 wherein more than 50% of the beam squint is prevented during operation over a frequency band of approximately 1 GHz.

8. An offset reflector antenna as defined in claim 1 wherein the antenna is tuned to substantially prevent beam squint by cooperatively tuning at least one of the feed and the reflector array.

9. An offset reflector antenna as defined in claim 1 comprising a feed including a plurality of offset feed elements at different locations, each feed element being resonant at a different frequency, for radiating at that resonant frequency, and for spatially correcting the feed location for radiation at different frequencies such that the signal incident upon the reflector is incident at a different angle and reflected from the first reflector in a substantially same direction when provided from any of the plurality of feed elements.

10. A reflector antenna for reflecting a signal, the reflector antenna comprising:

a first planar reflector array disposed to reflect the signal with a first beam squint;

a second planar reflector array disposed to receive the reflected signal from the first planar reflector and for reflecting the signal with a second beam squint, wherein the first beam squint and the second beam squint sum to form an approximately constant direction of reflection of a signal from the second planar reflector, the signal at any of a plurality of different frequencies being within a known frequency band.

11. A reflector antenna as defined in claim 10 wherein at least on the of the second planar reflector array and the first planar reflector array comprises reflecting elements including at least one of slots and conductive patches.

12. A reflector antenna as defined in claim 10 wherein the antenna is tuned to substantially prevent beam squint.

13. A reflector antenna as defined in claim 10 wherein the second planar reflector array is disposed to approximately maximize efficiency of the antenna during operation over a predetermined band of frequencies.

14. A reflector antenna as defined in claim 11 wherein a second planar reflector array dimension is determined according to the following equation $$T_y^{(2)} = \frac{\Delta\lambda_0}{\Delta\theta_{(0,1)}^{(1)}\left(\cos\theta_{(0,1)}^{(1)}\right)}$$

where $\theta_{(0,1)}^{(1)}$ is an incident signal angle at a centre frequency of the frequency band and $\Delta\theta_{(0,1)}^{(1)}$ is a variation of the same angle throughout the frequency, $T_y^{(2)}$ is lattice dimension along y and $\lambda_0$ is a free space wavelength.

15. A reflector antenna for reflecting a signal, the reflector antenna comprising:

a first planar reflector array including a plurality of reflector elements disposed to reflect the signal;

a feed including a plurality of feed elements, each feed element for radiating at a different frequency and spaced from the first reflector by a distance wherein the signal reflected from the first reflector has a substantially same direction when provided from any feed element of the plurality of feed elements at a frequency of radiating of said feed element.

16. A reflector antenna as defined in claim 15 wherein the feed elements are spaced from the reflector by a plurality of different distances.

17. A reflector antenna as defined in claim 16 wherein the feed element spacing is selected based on phase characteristics of radiation incident on the reflector array to provide a predetermined phase variation between incident radiation at two reflective elements within the reflector array.

18. A reflector antenna as defined in claim 15 wherein the feed elements are spaced from the reflector by a plurality of different distances, each feed element disposed in an approximately straight line.

19. A reflector antenna as defined in claim 15 wherein the feed comprises feed elements varying in size from smallest to largest and the feed spaced from the reflector by a distance, the distance determined using the following equation:

$$F_1M = \frac{F_1F_2}{\tan(\theta_2\theta_1)}$$

where $F_1M$ is a distance of a line perpendicular to the feed surface from the feed surface to a point M on the reflector array surface $F_1$ is a distance from a first end of the feed to the point M, $F_2$ is a distance from a second opposing end of the feed to the point M, and $\theta_1$ and $\theta_2$ are the directions to the first end of the feed and the second opposing end of the feed, respectively.

20. A reflector antenna as defined in claim 19 wherein the feed comprises four microstrip patches of different sizes, each microstrip patch coupled to a same feedline.

* * * * *

UNITED STATES PATENT AND TRADEMARK OFFICE

CERTIFICATE OF CORRECTION

PATENT NO. : 6,067,050

DATED : May 23, 2000

INVENTOR(S) : Shaker et al.

It is certified that error appears in the above-identified patent and that said Letters Patent is hereby corrected as shown below:

In the Drawings:

In sheet 7, Fig. 7, the legend should read: ——— $\theta_{out}$ for a dual reflector --------- $\theta_{out}$ for a single reflector Col. 4, line 28-29: "assumed to illuminated" should read -- assumed to be illuminated --;

Col. 4, formula 3 should read $k_{zm} = \sqrt{k_0^2 - k_{zmn}^2 - k_{ymn}^2}$

Signed and Sealed this

Fifteenth Day of May, 2001

*Attest:*

Nicholas P. Godici

NICHOLAS P. GODICI

*Attesting Officer*

*Acting Director of the United States Patent and Trademark Office*